US006715621B2

(12) United States Patent
Boron

(10) Patent No.: US 6,715,621 B2
(45) Date of Patent: Apr. 6, 2004

(54) PRODUCT MERCHANDISING DISPLAY UNIT WITH PULL THROUGH FRONT WALL MEMBERS

(75) Inventor: Andrew J. Boron, Belleville, IL (US)

(73) Assignee: Paul Flum Ideas, Inc., St. Louis, MO (US)

( * ) Notice: Subject to any disclaimer, the term of this patent is extended or adjusted under 35 U.S.C. 154(b) by 5 days.

(21) Appl. No.: 10/064,636

(22) Filed: Aug. 1, 2002

(65) Prior Publication Data

US 2004/0020877 A1 Feb. 5, 2004

(51) Int. Cl.[7] ..... A47F 1/12

(52) U.S. Cl. ..... 211/59.2; 211/74; 211/175; 211/184; 312/71

(58) Field of Search ..... 211/59.2, 153, 211/126.1, 175, 74, 75; 312/42, 71; 403/334, 333, 381; 248/310, 909, 309.1, 311.2, 312, 312.1, 313, 634, 615, 316.1, 316.5, 316.6, 316.7, 316.8

(56) References Cited

U.S. PATENT DOCUMENTS

| | | | | | |
|---|---|---|---|---|---|
| 2,218,444 | A | | 10/1940 | Vineyard | 211/59.2 |
| 2,572,090 | A | | 10/1951 | Allen | 211/49.1 |
| 4,191,296 | A | | 3/1980 | Morgan | 211/59.2 |
| 4,305,512 | A | * | 12/1981 | Mackenzie | 211/75 |
| 4,331,237 | A | | 5/1982 | Edell | 206/461 |
| 4,367,818 | A | * | 1/1983 | Suttles | 211/59.2 |
| 4,416,380 | A | | 11/1983 | Flum | 211/49 D |
| 4,454,949 | A | | 6/1984 | Flum | 211/49 D |
| 4,606,523 | A | * | 8/1986 | Statz et al. | 248/311.2 |
| 4,685,574 | A | | 8/1987 | Young et al. | 211/59.2 |
| 4,785,943 | A | | 11/1988 | Deffner et al. | 211/59.2 |
| 4,785,945 | A | | 11/1988 | Rowse et al. | 211/59.2 |
| 4,801,025 | A | | 1/1989 | Flum et al. | 211/128 |
| 4,923,070 | A | | 5/1990 | Jackle et al. | 211/59.2 |
| 4,953,719 | A | | 9/1990 | Spamer | 211/188 |
| 5,024,336 | A | | 6/1991 | Spamer | 211/59.2 |
| 5,050,748 | A | | 9/1991 | Taub | 211/59.2 |
| 5,351,838 | A | | 10/1994 | Flum | 211/59.2 |
| 5,396,997 | A | * | 3/1995 | Johnson | 211/59.2 |
| 5,417,333 | A | | 5/1995 | Flum | 211/59.2 |
| 5,450,968 | A | | 9/1995 | Bustos | 211/59.2 |
| 5,450,971 | A | | 9/1995 | Boron et al. | 211/134 |
| 5,531,336 | A | | 7/1996 | Parham et al. | 211/183 |
| D372,381 | S | | 8/1996 | Goldring et al. | D6/476 |
| 5,624,042 | A | | 4/1997 | Flum et al. | 211/59.2 |
| 5,634,564 | A | | 6/1997 | Spamer et al. | 211/59.3 |
| 5,645,176 | A | | 7/1997 | Jay | 211/59.2 |
| 5,645,182 | A | | 7/1997 | Miller, Jr. et al. | 211/134 |
| 5,695,074 | A | * | 12/1997 | Wiese | 211/59.2 |
| 5,706,957 | A | * | 1/1998 | Hardy | 211/59.2 |
| 5,957,327 | A | * | 9/1999 | Whiten | 221/289 |
| 6,068,142 | A | * | 5/2000 | Primiano | 211/183 |
| 6,082,556 | A | * | 7/2000 | Primiano et al. | 211/59.2 |
| 6,142,316 | A | | 11/2000 | Harbour et al. | 211/59.2 |

(List continued on next page.)

*Primary Examiner*—Daniel P. Stodola
*Assistant Examiner*—Jennifer E. Novosad
(74) *Attorney, Agent, or Firm*—Blackwell Sanders Peper Martin, LLP

(57) ABSTRACT

A product module for supporting and merchandising product containers therefrom including at least one elongated product channel defined by a pair of laterally spaced upstanding side walls and a substantially planar product supporting floor portion extending therebetween, each product channel having at least one front member spaced above the floor portion and partially bridging the product channel side walls, the at least one front member including a first wall portion extending from one of the product channel side walls and a second wall portion extending from the other of the product channel side walls. The first and second front wall portions define a space therebetween and are sufficiently resilient so as to allow a lead product container positioned within a product channel to be pulled therethrough to facilitate removal of the lead product container from the product channel.

31 Claims, 5 Drawing Sheets

U.S. PATENT DOCUMENTS 6,189,734 B1 * 2/2001 Apps et al. ..... 221/193
6,209,731 B1 * 4/2001 Spamer et al. ..... 211/59.2
6,220,557 B1 * 4/2001 Ziaylek et al. ..... 248/316.1
6,227,510 B1 * 5/2001 McMullen, Sr. ..... 248/311.2
6,325,221 B2 * 12/2001 Parham ..... 211/59.2
6,513,667 B2 * 2/2003 Battaglia et al. ..... 211/59.2
2001/0002658 A1 * 6/2001 Parham ..... 211/59.2
2001/0020606 A1 * 9/2001 Battaglia et al. ..... 211/59.2

* cited by examiner

PRODUCT MERCHANDISING DISPLAY UNIT WITH PULL THROUGH FRONT WALL MEMBERS

BACKGROUND OF INVENTION

The present invention relates generally to product display devices for use in storing and merchandising shelf products therefrom and, more particularly, to various embodiments of a product merchandising display unit which include at least one product channel, each product channel having a front member which only partially bridges the space at the front of each product channel between the respective side walls or guide members associated respectively therewith such that a product container positioned within the product channel can be at least partially pulled through the front member to facilitate removal of the product container from the product channel. The present pull through front wall feature is preferably incorporated into a plurality of product modules which can be assembled in a columnar array to achieve any desired width and any desired number of product channels depending upon the particular merchandising application. The present assemblies can be conveniently supported in either a substantially flat horizontal position or in an inclined position for gravity feeding products positioned thereon. Although the present devices are primarily designed for use in a wide variety of refrigerated display cases presently utilized in supermarkets, convenience stores, and other food and beverage outlets where vertical space within the refrigerated display case is at a premium, they are likewise adaptable for use in many other display shelf applications.

It is common practice to provide product merchandising display devices to organize and merchandise shelf products to consumers. This is particularly true with respect to displaying and merchandising chilled soft drink products in conventional refrigerated display coolers. See, for example, the display units disclosed in U.S. Pat. Nos. 5,024,336; 5,351,838; 5,417,333; and 5,531,336. It is also common practice to provide product merchandising display devices which include a plurality of product channels or modules which can be laterally interlocked together in side-by-side relationship to form an overall stabilized assembly for supporting products in a columnar array. See, for example, the display units disclosed in U.S. Pat. Nos. 4,685,574; 4,785,945; 5,050,748; 5,624,042; 5,634,564; 5,645,176; and 6,142,316. This adjustability has made such product display devices more accommodating for use with known refrigerated coolers having different spatial dimensions.

Since the advent of the larger product containers such as the 20 oz. and 1 liter product containers commonly utilized in the soft drink beverage industry, a wide variety of display devices have been designed and manufactured for use in merchandising these taller product containers. One problem encountered in merchandising these taller product containers is the fact that the vertical space between shelf members in a refrigerated cooler or other merchandising application is at a premium and often times such space is so minimal that removal of the lead product container from such unit becomes extremely difficult. This product removal problem is also complicated by the fact that many of the known display devices include higher product channel side walls and higher transversely extending front wall members in order to adequately support and hold these larger product containers within the respective product channels. As a result, the lead product container must be lifted up and over the higher front wall member in order to remove the product container from the respective product channel. Since the space between vertically spaced shelf members within a conventional refrigerated display cooler is typically kept to a minimum and is typically only slightly larger than the product containers positioned within the particular display device located on the shelf member, lifting the particular product containers over the higher front wall member is often times difficult in that the lead product container cannot be lifted upwardly in a substantially vertical direction without interference from the shelf member located thereabove. This may require a customer to lift and rotate the lead product container to an almost substantially horizontal position before the product container be removed from the respective product channel.

Although the present product display devices have, for the most part, been designed so as to more attractively arrange and position the various shelved products positioned thereon for easy accessibility and visibility by a customer at the front portion of the display unit, greater emphasis is now being placed on easily removing the larger product containers from their respective product channel without sacrificing vertical space between a plurality of shelf members which are vertically stackably arranged one above the other within a conventional refrigerated display cooler or other display shelf applications.

Accordingly, the present invention is directed to overcoming the removability problem associated with larger product containers as set forth above. cl SUMMARY OF INVENTION In one aspect of the present invention there is disclosed an adjustable product merchandising display assembly which is adaptable for use on and with existing shelving equipment, either on a flat shelf surface or on an inclined support structure for gravity feeding products therefrom. The present product merchandising display assemblies can be used for both chilled and unchilled products and are particularly well suited in merchandising and displaying a wide variety of products therefrom such as soft drink beverages, fruit juices, dairy products and the like in supermarkets, convenience stores, grocery outlets, fast food outlets, and a wide variety of other wholesale and retail stores. The present display assemblies are likewise equally adaptable for use in a wide variety of other product merchandising and storing applications.

Each of the several embodiments of the present invention disclosed herein comprise one or more product modules which can be laterally interlocked together in side-by-side relationship to form an overall stabilized assembly for supporting products positioned thereon in a columnar array. Each product module includes at least one product support channel for guiding products positioned therein, it being contemplated that the respective product channels may vary in lateral width not only to accommodate products of different dimensions, but also due to the fact that such product modules may include more product channels as compared to others. Each product module includes cooperatively engageable interlocking means associated with the respective side edge portions thereof such as the connection means disclosed in U.S. Pat. No. 5,624,042, which patent is assigned to the present assignee, Paul Flum Ideas, Inc. of St. Louis, Mo. The construction of the various product modules enables any number of such modules to be connected together in any preferred number to form a particular merchandising unit which not only conveniently fits in the allotted space, but also includes the maximum number of product channels for the particular type of product containers to be merchandised therefrom.

Importantly, each product channel includes at least an upper front wall member which only partially bridges the space between the respective product channel side walls at the front portion thereof. The present front wall member includes a pair of wall portions, each wall portion being attached to and extending from one of the side walls or guide members associated with each respective product channel. These front wall portions are made from a somewhat resilient material such that they are capable of bending and flexing as a product container is pulled through and between the separated front wall portions. Because the present front wall member only partially bridges the space at the front portion of each product channel, such front wall member is adequate to hold and retain product containers within each respective product channel, even in a gravity feed orientation, but the space between such front wall portions enables the product container to be tilted slightly forward and pulled through such front wall member thereby minimizing the upward lifting of the product container to remove it from the respective channel. This also, in turn, minimizes the vertical space necessary between adjacent vertically stacked shelf members to allow for easy removal of the product container therefrom without lifting such container totally above the front wall member.

Other embodiments of the present front wall member include the use of notches or other areas of reduced cross section to improve the flexibility and resiliency of the pair of front wall portions as product containers are pushed and pulled therebetween. These notches may be appropriately positioned and located on the respective front wall portions to achieve the desired flexibility in the particular directions desired. Also, any number of front wall members constructed in accordance with the teachings of the present invention may be utilized with respect to each product channel, and an intermediate continuous front wall member located between the present front wall member and the bottom of the product channel may likewise be utilized in conjunction with the present front wall member to provide additional stop means at the front of each product channel depending upon the size, shape and weight of the product containers merchandised therein.

These and other aspects and advantages of the present invention will become apparent to those skilled in the art after considering the following detailed specification which discloses several representative embodiments of the present product merchandising assembly in conjunction with the accompanying drawings.

BRIEF DESCRIPTION OF DRAWINGS

For a better understanding of the present invention, reference may be made to the accompanying drawings.

DETAILED DESCRIPTION

Figure 1:
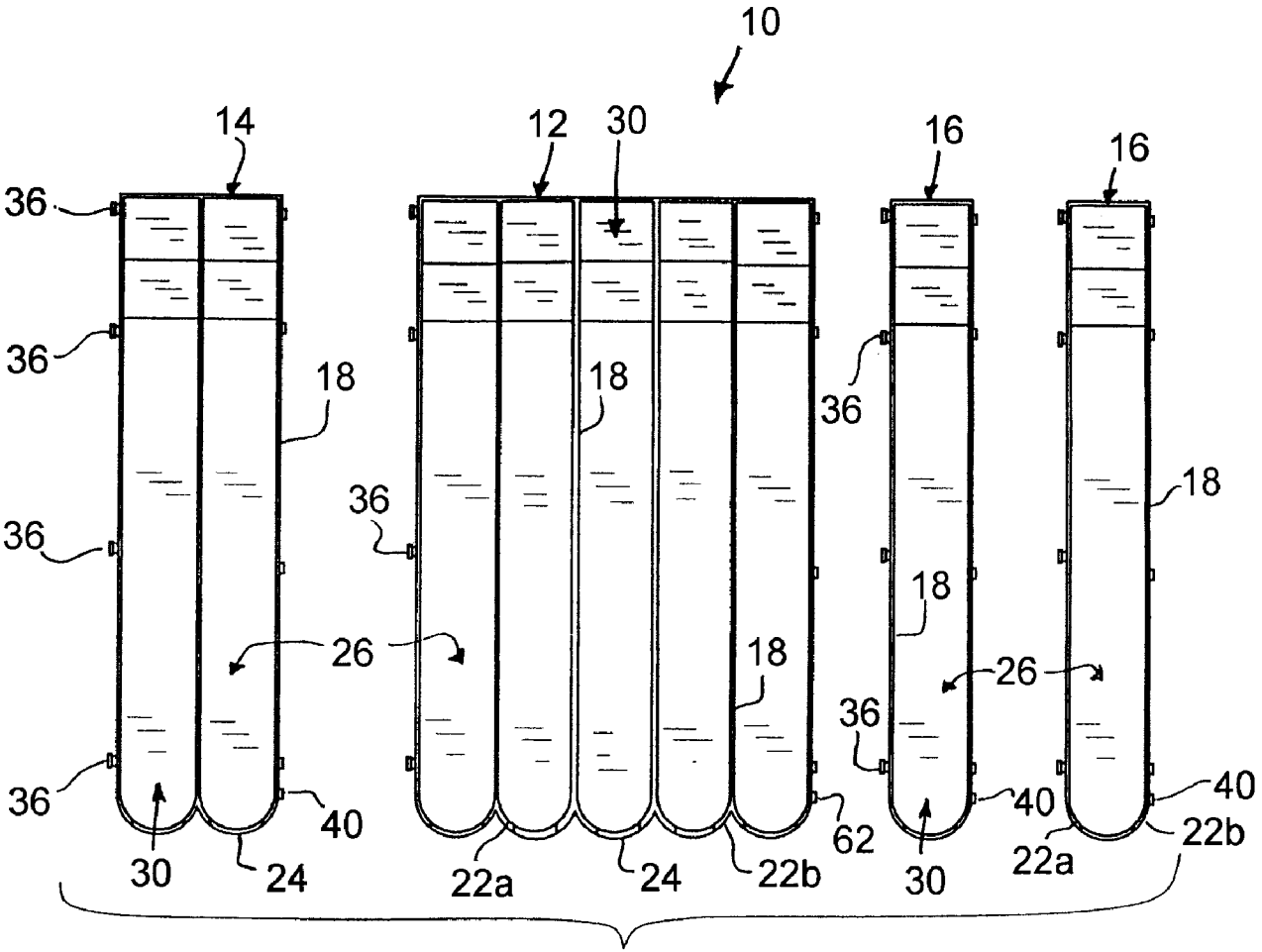
FIG. 1 is a top plan view of a plurality of product modules constructed according to the teachings of the present invention.

Referring to the drawings more particularly by reference numbers wherein like numerals refer to like parts, number 10 in FIG. 1 identifies one particular plurality of product modules constructed according to the teachings of the present invention, this particular plurality of product modules including a product module 12 having five product channels associated therewith, a product module 14 having two product channels associated therewith, and two separate product modules 16 each having a single product channel associated therewith. Since each product module 12, 14 and 16 is substantially similar in construction except for the number of product support channels associated therewith, and since each upper front wall member 22 associated with each product channel 30 of each product module is identical in construction, discussion of the present invention will be directed primarily to product module 16 as shown in FIGS. 2–4.

Figure 2:
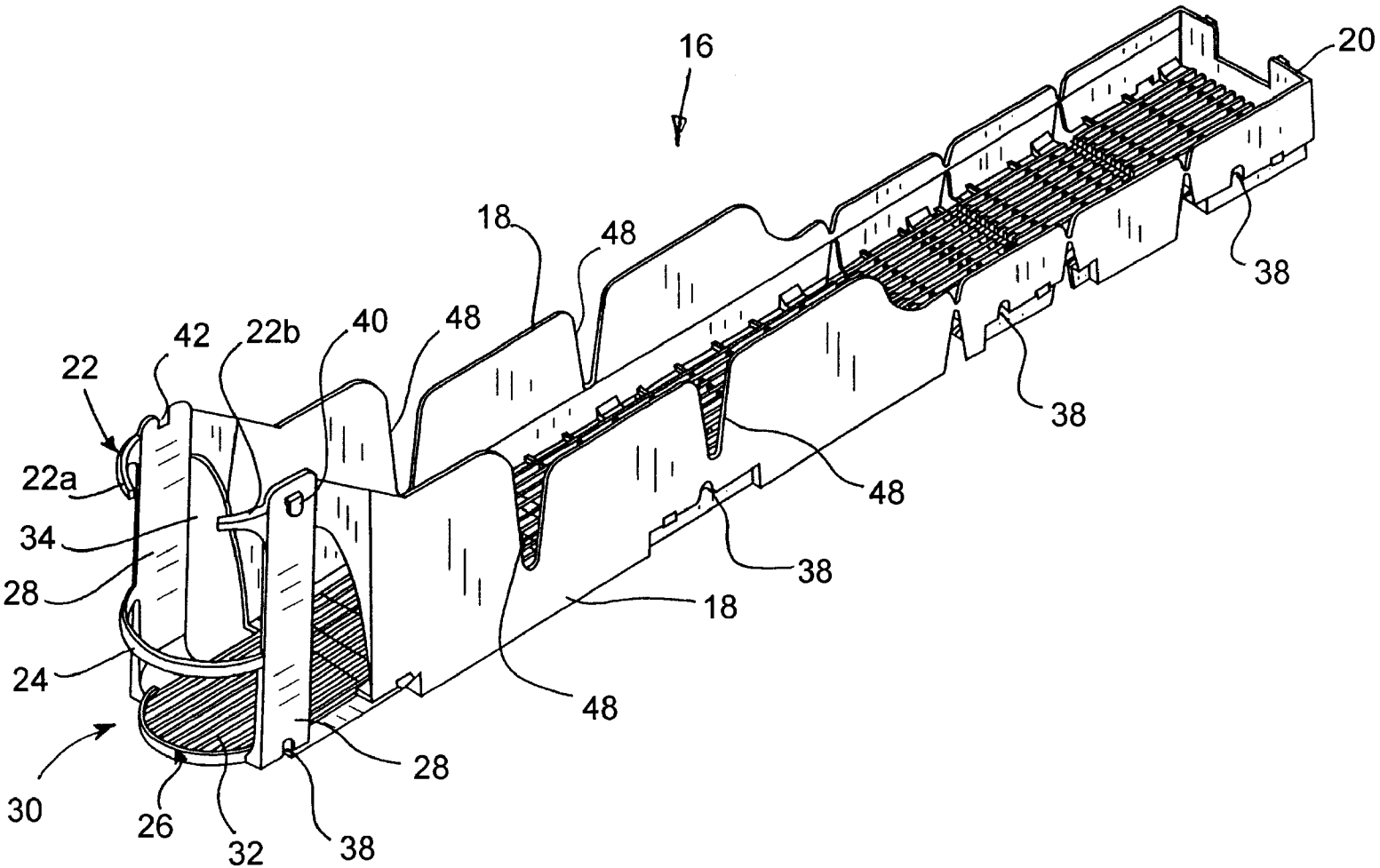
FIG. 2 is a perspective view of one of the product modules illustrated in FIG. 1, such product module having one product channel associated therewith and its construction being representative of one embodiment of the present modules illustrated in FIG. 1.
Figure 3:
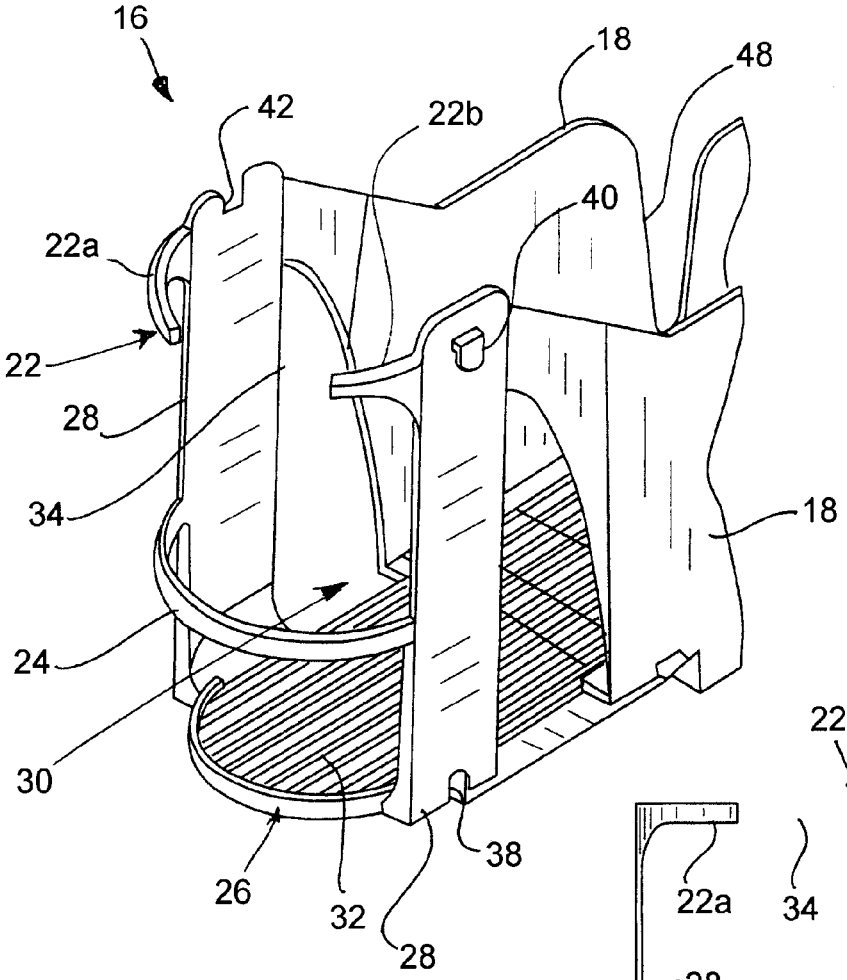
FIG. 3 is an enlarged partial perspective view of the front portion of the product module of FIG. 2.
Figure 4:
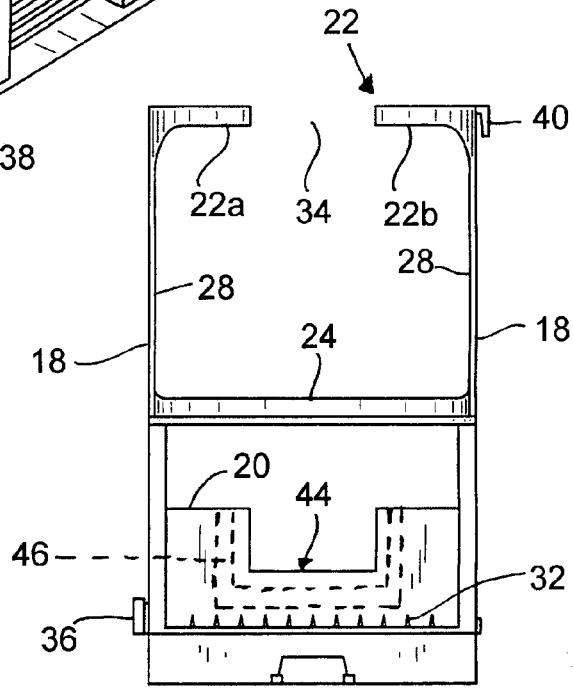
FIG. 4 is a front elevational view of the product module of FIGS. 2 and 3.

Referring primarily to FIGS. 2–4, one embodiment of product module 16 includes spaced upstanding guide members or side walls 18, a rear wall or edge portion 20, a pair of spaced arcuate front wall members 22 and 24, and a substantially planar floor portion 26 extending therebetween as best shown in FIG. 2. The module side wall members 18 define respectively therebetween a product channel 30 for supporting and guiding products positioned therebetween on the floor portion 26, the wall members 18 being either integrally formed with or attached to a pair of upright forward posts 28 located at the front portion of each product channel 30. It is recognized and anticipated that the side walls 18 may extend all the way forward to the front of the product module 16 and that the forward posts 28 may be eliminated and/or incorporated into a continuous side wall.

In the product modules 12 and 14 illustrated in FIG. 1, each product channel 30 is also defined by the floor portion 26 located between adjacent guide or side wall members 18. The guide or side wall members 18 are preferably integrally formed with the modules 12, 14 and 16 for ease of manufacture and to lend strength and stability to each product module. In this regard, it is recognized that other suitable means may also be used to attach the side members 18 to both the module floor structure 26 as well as to the upright posts 28.

The floor portion 26 of each product module such as the module 16 may also take on a wide variety of different configurations including a smooth planar surface or a wide variety of different track means such as the track configuration illustrated in FIGS. 2–4. In one embodiment, the floor portion 26 may include a plurality of spaced longitudinally extending ribs, rails or runners 32 which project upwardly therefrom as best shown in FIG. 4. The upstanding ribs or runners 32 form the respective support surface in each respective product channel 30 upon which products will be positioned for movement therealong. The rails or runners 32 are preferably integrally formed with the module structure such as through an injection molding process or other means for accomplishing this task. Because of the materials and lubricants used in the construction of the rail means 32, the rails or runners 32 reduce the friction between such surfaces and the products positioned thereon thereby improving the slidability of products as they move across such runners from the rear of each module to the front portion thereof. This is particularly important when the present modules are used in a gravity feed arrangement. The actual construction of the track runners 32 as well as the materials and lubricants used to improve the slidability of products positioned thereon are more fully disclosed and described in U.S. Pat. Nos. 4,801,025; 4,454,949; and 4,416,380, all of which are owned by the present assignee, Paul Flum Ideas, Inc. of St. Louis, Mo. It is also recognized that the spacing between the individual runners 32 may be varied to accommodate any and all of the various products that are to be positioned thereon regardless of the shape or contour of the bottom portions associated with such products.

Importantly, each product channel 30 associated with each product module 12, 14 and 16 includes an arcuate front wall member 22 which only partially extends across the space between the respective side walls 18 and/or post members 28 at the front of each product channel 30 as best illustrated in FIGS. 2–4. More particularly, the front wall member 22 includes a wall portion 22*a* which extends from one post member 28 and a front wall portion 22*b* which extends from the opposed post member 28 at the front of each product channel 30, the wall portions 22*a* and 22*b* being preferably in substantial horizontal alignment with each other as illustrated in FIGS. 2–4. The front wall portions 22*a* and 22*b* only partially bridge the space between the post members 28 and/or side walls 18 thereby defining an open space 34 therebetween. The size of the opening 34 between the respective front wall portions 22*a* and 22*b* can vary depending upon the size, shape and weight of the particular product containers to be merchandised within the product channel 30. Also, the wall portions 22*a* and 22*b* are preferably integrally formed with the upright posts 28, although the members 22*a* and 22*b* can be suitably attached to the members 28 by any suitable means. In this regard, it is also recognized and anticipated that the side walls 18 may extend all the way forward to the front of the product channel 30 and that the front wall portions 22*a* and 22*b* can be integrally formed or otherwise suitably attached to the side walls 18. The front wall member 22 is also fabricated from a flexible and/or resilient type of material such as a suitable plastic material so that the opening or space 34 between the terminal end portions of the respective front wall portions 22*a* and 22*b* can be expanded in size as a product container is pulled therethrough as will be hereinafter explained. It is also recognized and anticipated that although the front wall member 22 is shown as being arcuate in form, other front wall configurations can likewise be used depending upon the shape of the particular product containers being merchandised from a particular product channel 30 including extending flat across the product channel opening to accommodate products having a substantially flat front configuration. An arcuate front wall member is preferred when used with most beverage type products since beverage type containers are generally cylindrical in shape.

Because the pair of front wall portions 22*a* and 22*b* are made of a flexible, resilient type material, and because the front wall portions 22*a* and 22*b* do not extend all the way across the product channel opening between the respective upright posts 28 and/or side walls 18, the lead product container positioned in any product channel 30 can be tilted slightly forward and pulled through the opening 34 without completely lifting the product container up and over the front member 22. This accessibility and maneuverability of the lead product container substantially reduces the amount of vertical space necessary in order to easily remove the lead product container from a particular product channel. As a product container is pulled through the opening 34 by and between the front wall portions 22*a* and 22*b*, the force exerted against the wall portions 22*a* and 22*b* by the pulling motion in a direction towards the front of the module will cause the front wall portions 22*a* and 22*b* to flex outwardly towards the consumer thereby increasing the size of the opening 34 and allowing the product container to pass therethrough. Once the product container is pulled through the front member 22, due to their resiliency, the front wall portions 22*a* and 22*b* will thereafter return substantially to their original free or steady state positions. The type of material selected and the thickness and/or constructional features of the wall portions 22*a* and 22*b* should provide for this repeated flexibility and movement of the wall portions 22*a* and 22*b*.

Figure 9:
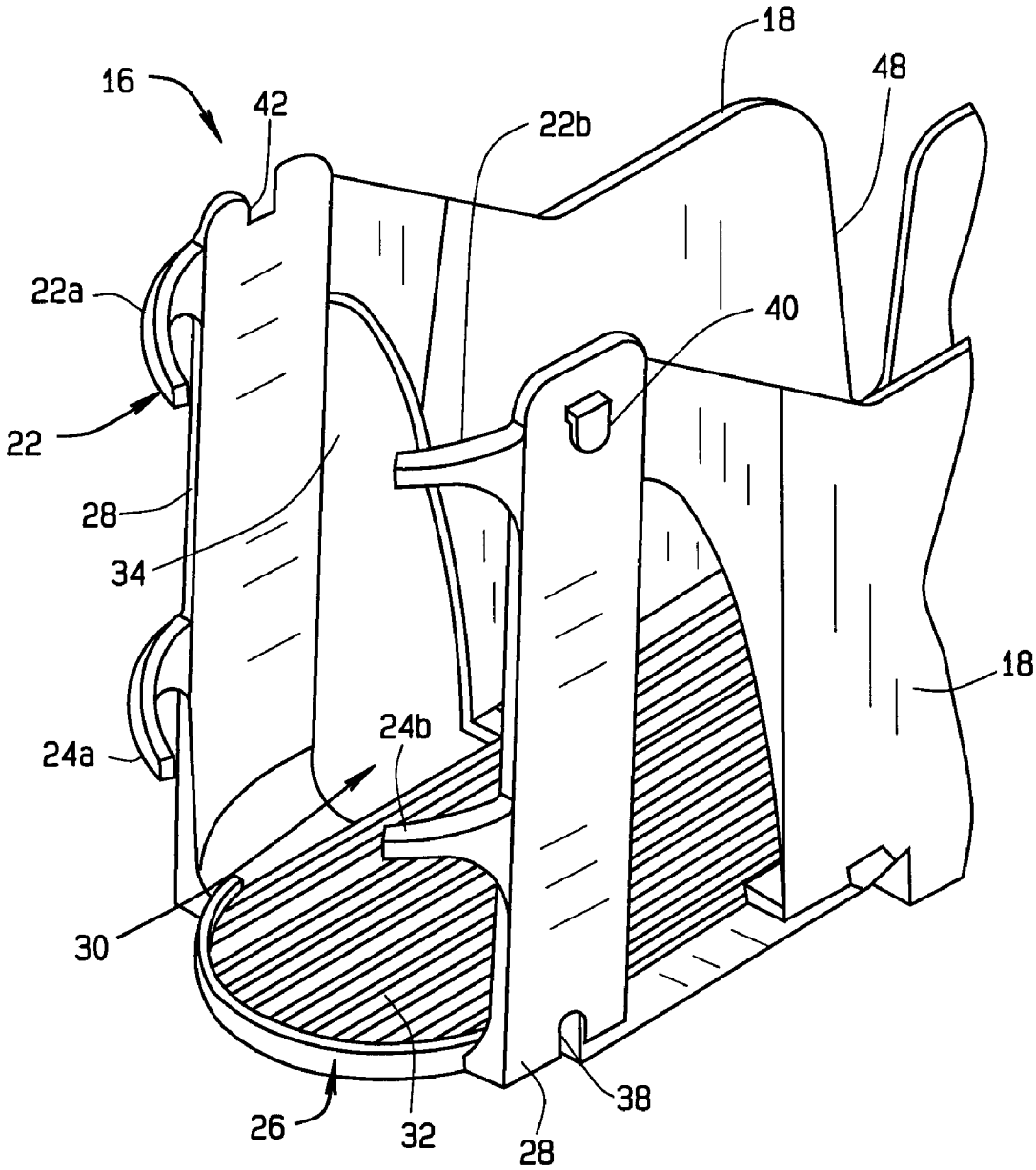
FIG. 9 is an enlarged partial perspective view of the front portion of a modified form of the product module of FIG. 2.

Each product channel 30 associated with each product module 12, 14 and 16 may likewise include a front wall member 24 which is positioned between the front wall member 22 and the floor portion 26 so as to provide an additional stop mechanism for preventing the product containers positioned within a respective product channel 30 from falling over and sliding out of the product channel between the front member 22 and the floor portion 26. In this regard, the intermediate front wall member 24 may extend continuously across the product channel 30 between the opposed upright posts 28 and/or side walls 18 as illustrated in FIGS. 2–4, or the intermediate front member 24 may likewise be comprised of a pair of front wall portions 24*a* and 24*b* (FIG. 9) similar to the front wall portions 22*a* and 22*b* (FIGS. 2, 3) previously described. Where the intermediate front wall 24 is a continuous member as illustrated, the lead product container will have to be lifted vertically a sufficient distance so as to clear the intermediate front member 24 when the product container is pulled through the front member 22. Nevertheless, because the lead product container can be inclined forward and pulled through the front member 22 during the removal process, the vertical distance traveled by the lead product container is minimal and the vertical space required between vertically spaced shelf members can be reduced as compared to other known display devices. Although the intermediate front member 24 will generally take on the same shape and contour as front member 22, it may likewise take on a wide variety of different shapes and configurations depending upon the shape of the particular product containers merchandised within each product channel 30. As with front member 22, front member 24 may likewise extend flat across the product channel opening.

Each product module 12, 14 and 16 may likewise include cooperatively engageable interlocking connection means associated with the respective outer side edge portions of each such product module in the form of a plurality of friction grip keepers 36 as well as a plurality of corresponding slots 38 as best shown in FIGS. 2–4. The keepers 36 and the corresponding slots 38 may be configured in accordance with the teachings and practice of U.S. Pat. No. 5,624,042, which patent is likewise assigned to the present assignee. Although use of the keepers 36 and slots 38 as disclosed in U.S. Pat. No. 5,624,042 are generally preferred, it is also recognized and anticipated that a wide variety of conventional mechanisms may be used to secure the product modules 12, 14 and 16 in a side-by-side columnar array such as those mechanisms disclosed in U.S. Pat. Nos. 4,685,574; 4,785,945; 5,050,748; 5,634,564; and 5,645,176. Still other coupling means may be equally as suitable, each having their own special advantages and disadvantages.

Each product module may likewise include an additional friction keeper member 40 located adjacent the upper edge forward portion of each product channel side wall 18 or member 28 as best illustrated in FIGS. 2–4, the friction keeper 40 being cooperatively engageable with the corresponding keying slot 42 located in opposed relationship adjacent the upper edge forward portion of the opposed side wall 18 or member 28 as likewise shown in FIGS. 2–4. Although use of the interlocking means 40 and 42 is optional, such use provides greater stability and security to the upper forward portion of two adjacent product modules particularly when such product modules are designed for displaying and merchandising the taller soft drink products. Here again, it is recognized that a wide variety of locking means can be utilized in place of keeper member 40 and its corresponding keying slot 42, and such other means may likewise work equally as well.

Referring to FIG. 4, the rear wall portion 20 of each product module may likewise include a recessed area 44 defining a slot or channel 46 adaptable for insertably receiving and holding product identification means such as a product label which would identify the particular product merchandised in that particular product channel. Use of a rear product identification label often times facilitates the proper loading and restocking of each product channel 30 when the product module is loaded or restocked from the rear of the unit. Such product label or other suitable product identification means should be removably replaceable within the slot or channel 46 so as to be compatible with the specific product brand being merchandised from that particular product channel.

The present product modules 12, 14 and 16 are typically supported by an underlying support structure used in conjunction with existing refrigerated cooler equipment. A wide variety of different support shelf structures are utilized with known refrigerated coolers and other types of cold vaults such as, for example, the shelf support structures disclosed in U.S. Pat. Nos. 5,450,971 and 5,645,182. The present product modules are compatible with the known underlying shelf structures and are merely positioned on top of such underlying support structures within the refrigerated cooler equipment. These underlying support structures are typically removably adjustable vertically within the refrigerated cooler so as to adjust the vertical space between each support structure depending upon the size of the product containers merchandised therefrom. The known underlying support structures are likewise adjustable between a substantially flat horizontal orientation and a gravity feed orientation. The present modules are also adaptable for use on conventional shelving and other support structures utilized in supermarkets, convenience stores and the like for merchandising non-chilled products.

Each of the parallel side wall members 18 associated with the present product modules 12, 14 and 16 may likewise be constructed optionally so as to be taller in overall height as well as flexible and/or resilient depending upon the size, shape and weight of the product containers to be merchandised therebetween. In addition, each side wall 18 may also include one or more slots or notches 48 as best shown in FIGS. 2 and 3 located at spaced locations along at least a portion of the length of each side wall 18, each slot or notch 48 extending in a vertical orientation as illustrated. The taller resilient product side walls 18 provide lateral support for taller products positioned in their respective product channels 30 so as prevent such taller products from tipping or toppling over into adjacent products or into adjacent product channels as such products are removed therefrom. Also, importantly, the side walls 18 serve to guide and direct any movement of the product containers along the respective channels 30 as the flexiblity of the side walls 18 enables smooth, free and unrestricted movement of the product containers within the channels 30 without binding, squeezing or otherwise hindering the product flow, particularly, in a gravity feed situation. The specific function and constructional details associated with the taller flexible slotted side walls 18 as well as variations thereof are fully explained and disclosed in U.S. Pat. No. 5,351,838, which patent is likewise assigned to the present assignee.

Figure 5:
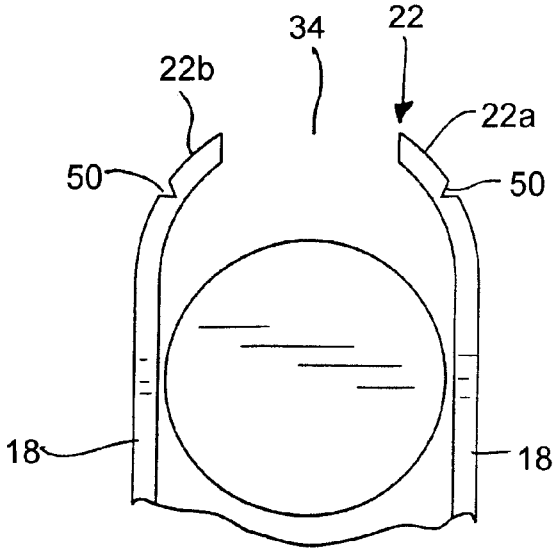
FIG. 5 is a partial top plan view illustrating another embodiment of the present front wall member.

FIG. 5 illustrates another embodiment of the product module 16 wherein the front wall portions 22*a* and 22*b* which comprise front wall member 22 each include at least one notch or area of reduced cross section 50 positioned and located so as to improve the bending and flexing of the front wall portions 22*a* and 22*b* when such wall portions are moved in a direction towards the rear of product channel 30. Although not generally recommended, it is anticipated that when the present product modules 12, 14 and 16 are loaded from the front portion of the unit, product stockers will inevitably push the product containers through the space 34 located between the respective front wall portions 22*a* and 22*b* in a direction towards the rear of the product module thereby flexing the wall portions 22*a* and 22*b* in a rearward direction. The notches 50 are strategically positioned and located extending from the front peripheral edge portion of the front wall portions inwardly as illustrated so as to improve the flexibility of the wall portions 22*a* and 22*b* when moved towards the product channel 30 in a rearward direction. The notches 50 as positioned and located will thereby substantially reduce and/or prevent premature breakage of the front wall portions 22*a* and 22*b* when flexed in a rearward direction. It is recognized and anticipated that any number of notches 50 may be positioned and located along the front peripheral edge portion of the respective wall portions depending upon the type of material utilized and the flexibility and resiliency of such front wall portions. The size and shape of each notch 50 may vary depending upon the particular merchandising application including the size, shape and weight of the product container as well as the constructional features and thickness of the front wall portions 22*a* and 22*b*. The notches 50 are optional and may be used if restocking the present modules from the front thereof through the front wall member 22 presents a breakage problem. In all other respects, the construction and operation of the product module 16 illustrated in FIG. 5 is substantially similar to the construction and operation of the product module 16 illustrated in FIGS. 2–4.

Figure 6:
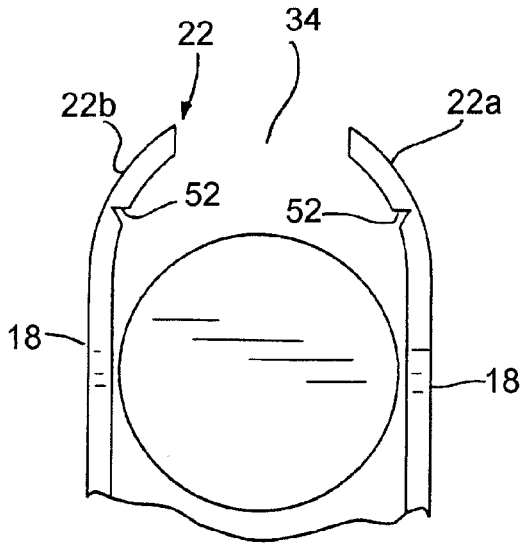
FIG. 6 is a partial top plan view illustrating still another embodiment of the present front wall member.

FIG. 6 illustrates still another embodiment of the present product module 16 wherein the respective front wall portions 22*a* and 22*b* each include one or more notches 52 extending inwardly from the rear peripheral edge portion thereof as illustrated. As with the notches 50 illustrated in FIG. 5, the notches 52 serve to improve the flexibility and resiliency of the front wall members 22*a* and 22*b* during the product removal process when such wall portions are flexed outwardly towards the front of the product channel 30 and towards the consumer. Here again, depending upon the size, shape and weight of the product containers merchandised from each product channel 30 as well as the constructional features and thickness of the front wall portions 22*a* and 22*b* including the type of material utilized, any one or more of the notches 52 can optionally be utilized to improve flexing of the wall portions 22*a* and 22*b* during the product removal process to again prevent and/or substantially reduce premature breakage of the front wall portions 22*a* and 22*b*. Also, the shape and size of the notches 52 as well as their positioning along the rear peripheral edge portion of the wall portions 22*a* and 22*b* may vary depending upon the merchandising parameters discussed above. In all other respects, the construction and operation of the product module 16 illustrated in FIG. 6 is substantially similar to the construction and operation of the product module 16 illustrated in FIGS. 2–4.

Figure 7:
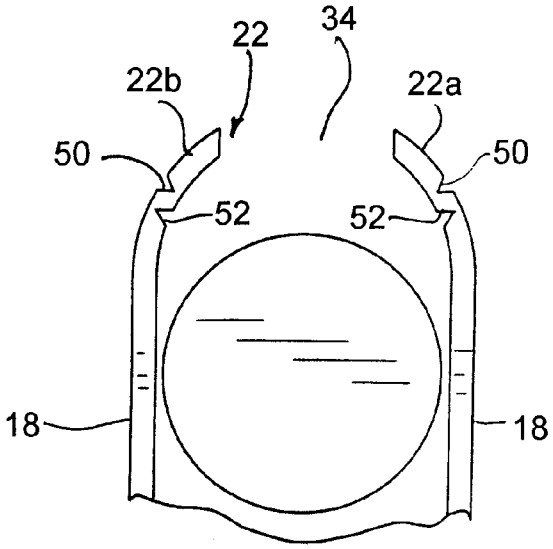
FIG. 7 is a partial top plan view illustrating yet another embodiment of the present front wall member.

FIG. 7 illustrates still a further embodiment of the product module 16 wherein the respective front wall portions 22*a* and 22*b* include one or more notches 50 and 52 as previously described. The notches 50 and 52 can be used in conjunction with each other on a particular front wall member 22 to improve the flexing capability of each respective wall portion 22*a* and 22*b* in both directions. In this particular embodiment, the notches 50 and 52 should be strategically positioned and spaced relative to each other so as not to substantially weaken or hinder the flexing of the front wall portions 22*a* and 22*b* in any one direction. Here again, use of the notches 50 and 52 are optional depending upon the particular merchandising application including the size, shape and weight of the product containers to be merchandised within the respective product channels 30 as well as the type of material utilized and the constructional features associated with the front wall member 22. In all other respects, the construction and operation of the product module 16 illustrated FIG. 7 is substantially similar to the construction and operation of the product module 16 illustrated in FIGS. 2–4.

Figure 8:
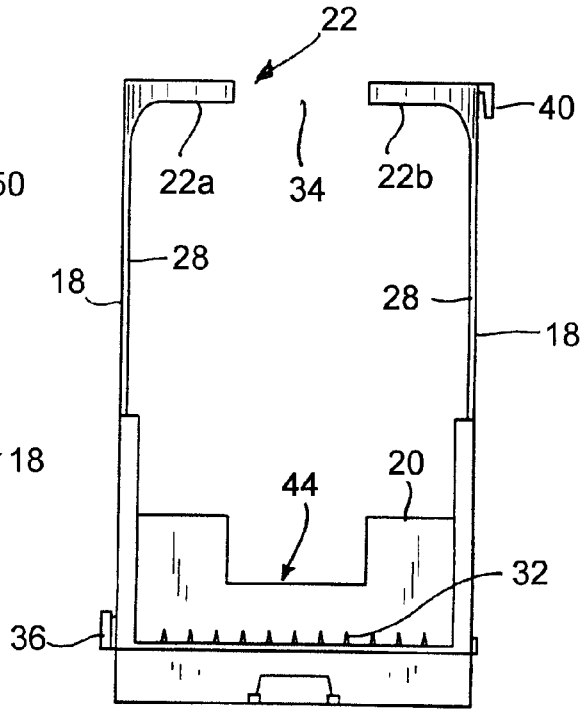
FIG. 8 is a front elevational view illustrating another embodiment of the product module of FIGS. 2 and 3.

FIG. 8 illustrates still another embodiment of the product module 16 which is substantially similar in construction and operation to the product module illustrated in FIG. 4 but differs therefrom only in that the lower front member 24 has been eliminated. In certain merchandising applications, use of a single front wall member 22 may be more than adequate to properly restrain the product containers positioned therebehind within any particular product channel 30. In this case, the vertical space necessary to remove a product container positioned within product channel 30 illustrated in FIG. 8 is substantially reduced since the product container can be pulled forward through the space 34 between front wall portions 22*a* and 22*b* without hardly any lifting motion at all. It is also recognized that, in this particular arrangement, the front wall portions 22*a* and 22*b* do not have to be positioned and located at the upper edge portion of the upright posts 28 and/or side walls 18, but instead, may be spaced therefrom and located a predetermined distance below the upper edge portion of the members 28 and/or 18 depending upon the configuration of the particular product containers merchandised within the channel 30 so long as the front wall portions 22*a* and 22*b* engage the product containers at a location sufficient to adequately hold the product container in an upright position within the channel 30. This is also true with respect to the positioning and location of the front wall portions 22*a* and 22*b* illustrated in FIGS. 2–7. In all other respects, the construction and operation of the product module 16 illustrated in FIG. 8 is substantially similar to the construction and operation of the product module 16 illustrated in FIGS. 2–4.

It is also recognized and anticipated that the width of each product channel 30 associated with the various embodiments of the present product modules may be varied to accommodate different size product containers such as 12 oz., 16 oz., 20 oz., one liter, two liter, and three liter soft drink containers presently utilized in the soft drink industry. It is also recognized that the width of the product channels 30 may vary within the same product module. For example, the width associated with some or all of the five product channels 30 illustrated in module 12 may be different from each other so that some product channels are capable of merchandising smaller product containers therefrom while other product channels in the same product module are capable of merchandising larger product containers therefrom. Also, importantly, all of the present product modules are reusable and can be easily attached and detached, at will, to adjacent modules to achieve any desired width and any desired number of product channels depending upon the particular merchandising application. This includes use of the present modules in a wide variety of known product merchandising display equipment including conventional refrigerated coolers.

It is also recognized and anticipated that the front wall portions 22*a* and 22*b* can be incorporated into any product merchandising display unit, whether such unit is modular or otherwise, to improve the removability and accessibility of the product containers positioned therewithin.

Thus, there has been shown and described several embodiments of a novel product modular assembly for use in storing and merchandising shelved products, including products requiring refrigeration, which devices are easily adaptable for use on existing shelving equipment and fulfil all the objects and advantages sought therefor. Many changes, modifications, variations and other uses and applications of the present constructions will, however, become apparent to those skilled in the art after considering this specification and the accompanying drawings. All such changes, modifications, variations and other uses and applications which do not depart from the spirit and scope of the present invention are deemed to be covered by the present invention which is limited only by the claims which follow.

What is claimed is:

1. A product module for supporting and merchandising product containers therefrom comprising at least one elongated product channel having front and rear portions, said product channel being defined by a pair of laterally spaced upstanding side walls and a substantially planar product supporting floor portion extending therebetween, each of said product channel side walls having opposed front and back portions and defining a space therebetween, at least one front member spaced above said floor portion and partially bridging said product channel side walls, said at least one front member including a first wall portion extending from one of said pair of product channel side walls and a second wall portion extending from the other of said pair of product channel side walls, said first and second front wall portions defining a space therebetween and being resiliently bendable so as to allow at least a portion of the lead product container positioned within said product channel to be pulled through the space defined between said first and second front wall portions moving each of said first and second front wall portions from a respective steady state position to a bent position.

2. The product module defined in claim 1 wherein said first and second front wall portions are positioned and located adjacent the upper edge portions of said product channel side walls.

3. The product module defined in claim 1 wherein said first and second front wall portions return substantially to their steady state positions once a lead product container is pulled through the space defined therebetween.

4. The product module defined in claim 1 including a second front member associated with each product channel, said second front member extending from at least one of said pair of product channel side walls and at least partially bridging the space therebetween, said second front member being disposed intermediate said at least one front member and the floor portion associated with each product channel.

5. The product module defined in claim 4 wherein said second front member includes a first wall portion extending from one of said pair of product channel side walls and a second wall portion extending from the other of said pair of product channel side walls, said first and second wall portions associated with said second front member defining a space therebetween.

6. The product module defined in claim 4 wherein said second front member completely bridges the space between said product channel side walls.

7. The product module defined in claim 1 wherein each of said first and second front wall portions includes opposed front and rear peripheral edge portions, each of said first and second front wall portions further including at least one notch extending inwardly from one of said front and rear peripheral edge portions.

8. The product module defined in claim 7 wherein each of said first and second front wall portions further includes at least one notch extending inwardly from the other of said front and rear peripheral edge portions.

9. The product module defined in claim 1 wherein said product module includes opposed side portions, and cooperatively engageable means associated with the respective side portions of said product module enabling said module to be coupled together with a substantially similarly constructed module.

10. The product module defined in claim 9 wherein said cooperatively engageable means associated with the respective side portions of said product module include a keeper member located adjacent the upper and forward portion of one of said opposed product module side portions and a corresponding keying slot located in opposed relationship adjacent the upper and forward portion of said other opposed product module side portion.

11. The product module defined in claim 9 including a plurality of said product modules laterally coupled together in side-by-side relationship to form a composite assembly for supporting product containers therein.

12. The product module defined in claim 11 wherein said plurality of product modules include modules which differ in width.

13. The product module defined in claim 11 wherein at least some of said plurality of modules include modules having a different number of product channels associated therewith.

14. The product module defined in claim 11 wherein said floor portion includes track means extending therealong within said product channel for supporting product containers positioned thereon.

15. The product module defined in claim 1 wherein said product channel side walls include means for allowing portions thereof to flex sidewardly to prevent binding of product containers located in said product channels.

16. The product module defined in claim 1 wherein each of said product channels includes a rear wall portion, said rear wall portion including means for receiving and holding a product identification card.

17. The product module defined in claim 16 wherein said means for receiving and holding a product identification card includes a channel formed in said rear wall portion.

18. A product module for supporting and merchandising product containers therefrom comprising at least one elongated product channel having front and rear portions, said product channel being defined by a pair of laterally spaced upstanding side walls and a substantially planar product supporting floor portion extending therebetween, first and second front members associated with each product channel, said first front member being spaced above said floor portion and extending partially across said product channel, said second front member being disposed intermediate said first front member and said floor portion and extending at least partially across said product channel, said first front member including a first front wall portion extending from one of said product channel side walls and a second front wall portion extending from the other of said product channel side walls, said first and second front wall portions associated with said first front member being resiliently bendable so as to allow at least a portion of a lead product container to be pulled therebetween to remove the lead product container from said product channel, said first and second front wall portions being movable in response to a force exerted thereagainst in a direction towards the front of the product module as the lead product container is being pulled therebetween.

19. The product module defined in claim 18 wherein each of said first and second front wall portions associated with said first front member includes front and rear peripheral edge portions, each of said first and second front wall portions including at least one notch extending inwardly from the front peripheral edge portion thereof.

20. The product module defined in claim 18 wherein each of said first and second front wall portions associated with said first front member includes front and rear peripheral edge portions, said first and second front wall portions including at least one notch extending inwardly from the rear peripheral edge portion thereof.

21. The product module defined in claim 18 wherein each of said first and second front wall portions associated with said first front member includes front and rear peripheral edge portions, each of said first and second front wall portions including at least one notch extending inwardly from the front peripheral edge portion thereof and at least one notch extending inwardly from the rear peripheral edge portion thereof.

22. The product module defined in claim 18 wherein said product module includes opposed side portions, and cooperatively engageable means associated with the respective side portions of said product module enabling said module to be coupled together with a substantially similarly constructed module.

23. The product module defined in claim 22 including a plurality of said product modules laterally coupled together in side-by-side relationship to form a composite assembly for supporting product containers therein.

24. The product module defined in claim 23 wherein said plurality of product modules include modules which differ in width.

25. The product module defined in claim 23 wherein at least some of said plurality of modules include modules having a different number of product channels associated therewith.

26. A product merchandising display unit comprising at least one product channel, each product channel having front and rear portions and each being defined by a pair of laterally spaced upstanding side walls and a substantially planar product supporting floor portion extending therebetween, a first front wall portion spaced above said floor portion and extending from one of said pair of product channel side walls, said first front wall portion partially bridging said product channel side walls, a second front wall portion spaced above said floor portion extending from the other of said pair of product channel side walls, said second front wall portion partially bridging said product channel side walls, said first and second front wall portions defining a space therebetween and being resiliently bendable so as to allow a lead product container positioned within said product channel to be pulled through the space defined between said first and second front wall portions.

27. The product merchandising display unit in claim 26 wherein said first and second front wall portions are positioned in substantial horizontal alignment with each other.

28. The product merchandising display unit defined in claim 26 wherein said first and second front wall portions are positioned and located adjacent the upper edge portions of said product channel side walls.

29. The product merchandising display unit defined in claim 26 including a second front member associated with each product channel, said second front member extending from at least one of said pair of product channel side walls and at least partially bridging the space therebetween, said second front member being disposed intermediate said first and second front wall portions and the floor portion associated with each product channel.

30. In a product merchandising display unit for merchandising product containers therefrom wherein said display unit includes at least one product channel having front and rear portions, said product channel being defined by a pair of laterally spaced upstanding side walls and a substantially planar product supporting floor portion extending therebetween, the improvement comprising at least one front wall member spaced above said floor portion and partially bridging said product channel side walls, said at least one front wall member including a first wall portion extending from one of said pair of product channel side walls and a second wall portion extending from the other of said pair of product channel side walls, said first and second front wall portions defining a space therebetween and being resiliently bendable so as to allow a lead product container positioned within said product channel to be pulled through the space defined therebetween.

31. The product merchandising unit defined in claim 30 wherein said first and second front wall portions are arcuate in shape.

* * * * *